US007798588B2

(12) United States Patent
Arazaki

(10) Patent No.: US 7,798,588 B2
(45) Date of Patent: Sep. 21, 2010

(54) LIQUID EJECTING APPARATUS AND LIQUID EJECTING METHOD

(75) Inventor: Shinichi Arazaki, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 297 days.

(21) Appl. No.: 12/166,186

(22) Filed: Jul. 1, 2008

(65) Prior Publication Data

US 2009/0009543 A1 Jan. 8, 2009

(30) Foreign Application Priority Data

Jul. 6, 2007 (JP) ..... 2007-178675

(51) Int. Cl.
*B41J 29/38* (2006.01)
*B41J 29/393* (2006.01)
*B41J 2/165* (2006.01)

(52) U.S. Cl. ..... 347/9; 347/19; 347/23

(58) Field of Classification Search ..... 347/9, 347/19, 23
See application file for complete search history.

(56) References Cited

U.S. PATENT DOCUMENTS

2006/0284922 A1* 12/2006 Beak ..... 347/23
2007/0035574 A1* 2/2007 Taga et al. ..... 347/23

FOREIGN PATENT DOCUMENTS

| | | |
|---|---|---|
| JP | 09-277670 | 10/1997 |
| JP | 2001-296420 | 10/2001 |
| JP | 2003-118133 | 4/2003 |
| JP | 2003-282247 | 10/2003 |
| JP | 2004-174750 | 6/2004 |
| JP | 2004-174816 | 6/2004 |
| JP | 2004-216339 | 8/2004 |
| JP | 2006-004402 | 1/2006 |

* cited by examiner

*Primary Examiner*—Matthew Luu
*Assistant Examiner*—Jannelle M Lebron
(74) *Attorney, Agent, or Firm*—Hogan Lovells US LLP

(57) ABSTRACT

A liquid ejecting apparatus includes a plurality of nozzles that eject a liquid, a sensor that detects a defective nozzle in which defective ejection occurs when the liquid is to be ejected, a recovery mechanism that recovers the defective nozzle to its normal state so as to enable the liquid to be normally ejected from the defective nozzle, and a control unit that, when a defective nozzle is detected, compares a method, in which the liquid is ejected after the defective nozzle is recovered to its normal state by the recovery mechanism, with a method, in which the liquid is ejected without using the defective nozzle, while the defective nozzle is not recovered to its normal state, and controls the liquid to be ejected by using the method having a shorter processing time.

7 Claims, 11 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

Examples of liquid ejecting apparatuses include an ink jet printer that ejects ink onto a medium, such as paper, cloth, or film, from nozzles, to thereby perform printing. In recent years, as such an ink jet printer, a line head printer that is provided with a nozzle array having a length corresponding to the paper width in a direction intersecting a transport direction of the medium has been developed.

In an ink jet printer, defective ejection may occur, that is, ink may not be normally ejected, due to ink thickening or dust sticking. There has been suggested a cleaning method, such as flushing or pump suction, which, when a defective nozzle in which defective ejection occurs is detected, enables ink to be normally ejected from the defective nozzle (JP-A-2003-118133).

However, printing is suspended during cleaning, and accordingly if cleaning is performed, a print time (processing time) may be much longer.

SUMMARY

An advantage of some aspects of the invention is that it is possible to reduce a print time.

According to an aspect of the invention, a liquid ejecting apparatus includes a plurality of nozzles that eject a liquid, a sensor that detects a defective nozzle in which defective ejection occurs when the liquid is to be ejected, a recovery mechanism that recovers the defective nozzle to its normal state so as to enable the liquid to be normally ejected from the defective nozzle, and a control unit that, when a defective nozzle is detected, compares a method, in which the liquid is ejected after the defective nozzle is recovered to its normal state by the recovery mechanism, with a method, in which the liquid is ejected without using the defective nozzle, while the defective nozzle is not recovered to its normal state, and controls the liquid to be ejected by using the method having a shorter processing time.

Features and advantages of the invention other than the above will become clear by reading the specification with reference to the accompanying drawings.

BRIEF DESCRIPTION OF THE DRAWINGS

The invention will be described with reference to the accompanying drawings, wherein like members reference like elements.

DESCRIPTION OF EXEMPLARY EMBODIMENTS

Outline of Disclosure

Figure 1:
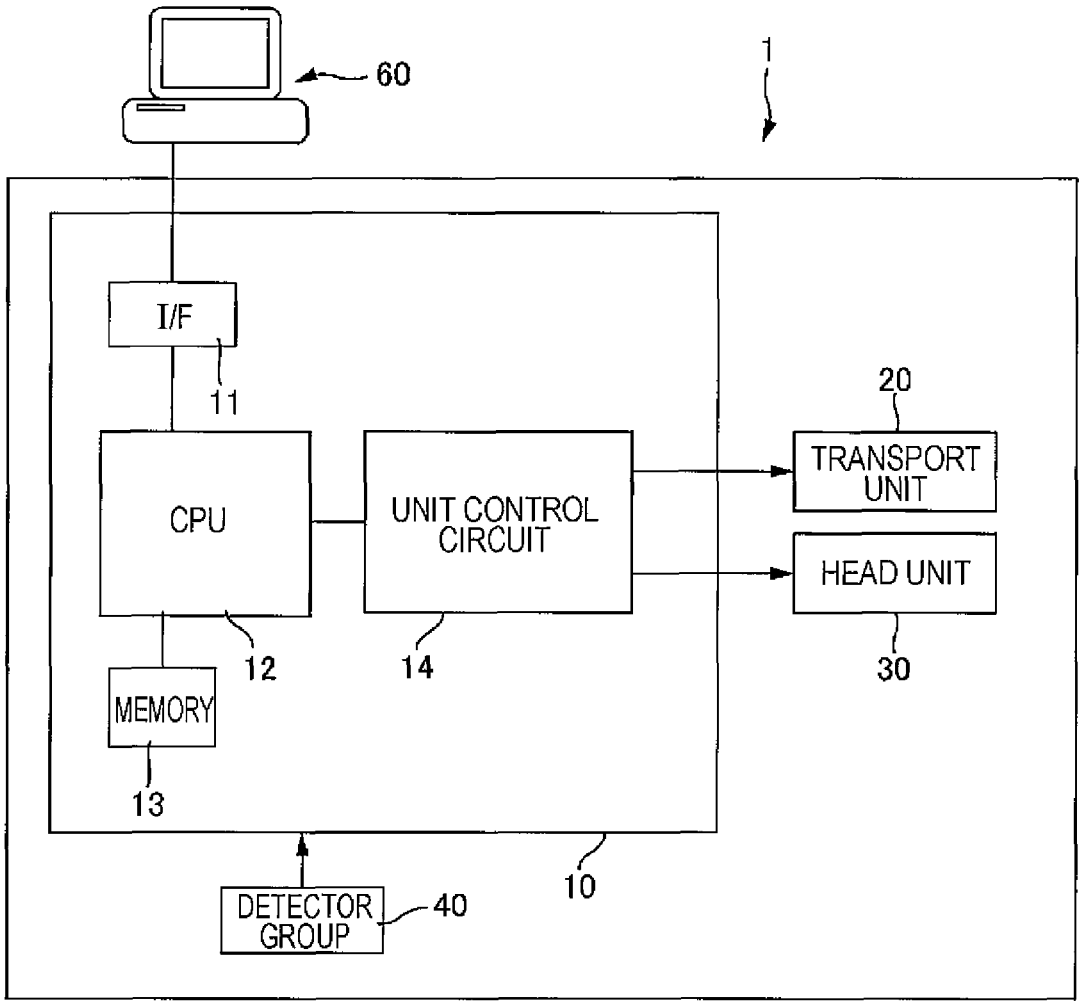
FIG. 1 is a block diagram illustrating the overall configuration of a printer according to an embodiment of the invention.

At least the following will become apparent according to the specification and the accompanying drawings.

According to an aspect of the invention, a liquid ejecting apparatus includes: a plurality of nozzles that eject a liquid; a sensor that detects a defective nozzle in which defective ejection occurs when the liquid is to be ejected; a recovery mechanism that recovers the defective nozzle to its normal state so as to enable the liquid to be normally ejected from the defective nozzle; and a control unit that, when a defective nozzle is detected, compares a method, in which the liquid is ejected after the defective nozzle is recovered to its normal state by the recovery mechanism, with a method, in which the liquid is ejected without using the defective nozzle, while the defective nozzle is not recovered to its normal state, and controls the liquid to be ejected by using the method having a shorter processing time.

With this liquid ejecting apparatus, a processing time can be reduced so as to be as short as possible.

In the liquid ejecting apparatus according to the aspect of the invention, when the liquid is ejected without using the defective nozzle, for a pixel assigned with the defective nozzle, the liquid may be ejected from another nozzle that can eject the liquid normally.

With this liquid ejecting apparatus, even if the defective nozzle is not used, image deterioration due to a dead dot can be suppressed.

In the liquid ejecting apparatus according to the aspect of the invention, a plurality of nozzle arrays each having a plurality of nozzles may be provided, and when a defective nozzle is detected, the control unit may compare a method, in which the liquid is ejected after the defective nozzle is recovered to its normal state by the recovery mechanism, with a method, in which the liquid is ejected without using a nozzle array in which the defective nozzle is detected, while the defective nozzle is not recovered to its normal state.

With this liquid ejecting apparatus, a processing time can be reduced so as to be as short as possible.

The liquid ejecting apparatus according to the aspect of the invention may further include a transport mechanism that transports a medium in a transport direction. The plurality of nozzle arrays may be arranged in line along the transport direction, and when the liquid is ejected without using the nozzle array in which the defective nozzle is detected, for pixels arranged in a line along the transport direction, nozzle arrays in which no defective nozzle is detected may be sequentially allocated.

With this liquid ejecting apparatus, it can be ensured that a time from when a nozzle array ejects the liquid until the nozzle array ejects the liquid next time is as long as possible, and the nozzle array can be ready to eject the liquid next time during the time. Therefore, a medium transport speed can be made as fast as possible. As a result, a processing time can be reduced. In addition, the nozzle arrays can be evenly used.

In the liquid ejecting apparatus according to the aspect of the invention, the control unit may compare a time, which is the sum of a time required to recover the defective nozzle to its normal state by using the recovery mechanism and a time required to eject the liquid by using all of the plurality of nozzles, with a time required to eject the liquid without using the defective nozzle.

With this liquid ejecting apparatus, a liquid ejecting method having a shorter processing time can be determined.

In the liquid ejecting apparatus according to the aspect of the invention, the method of ejecting the liquid after the recovery and the method of ejecting the liquid without using the defective nozzle are compared with each other, and when the processing times of both methods are the same, the liquid may be ejected without using the defective nozzle.

With this liquid ejecting apparatus, liquid consumption of the recovery mechanism can be reduced.

According to another aspect of the invention, a liquid ejecting method includes: in a liquid ejecting apparatus including a plurality of nozzles that eject a liquid, a sensor that detects a defective nozzle in which defective ejection occurs when the liquid is to be ejected, and a recovery mechanism that recovers the defective nozzle to its normal state so as to enable the liquid to be normally ejected from the defective nozzle, examining presence/absence of a defective nozzle by means of the sensor; when a defective nozzle is detected, comparing a method, in which the liquid is ejected after the defective nozzle is recovered to its normal state by the recovery mechanism, with a method, in which the liquid is ejected without using the defective nozzle, while the defective nozzle is not recovered to its normal state, and determining a method having a shorter processing time; and ejecting the liquid by using the determined method.

With this liquid ejecting apparatus, a processing time can be reduced so as to be as short as possible.

Line Head Printer

Hereinafter, an embodiment of the invention will be described by using an ink jet printer as an example of a liquid ejecting apparatus, in particular, a line head printer (printer 1).

Figure 2:
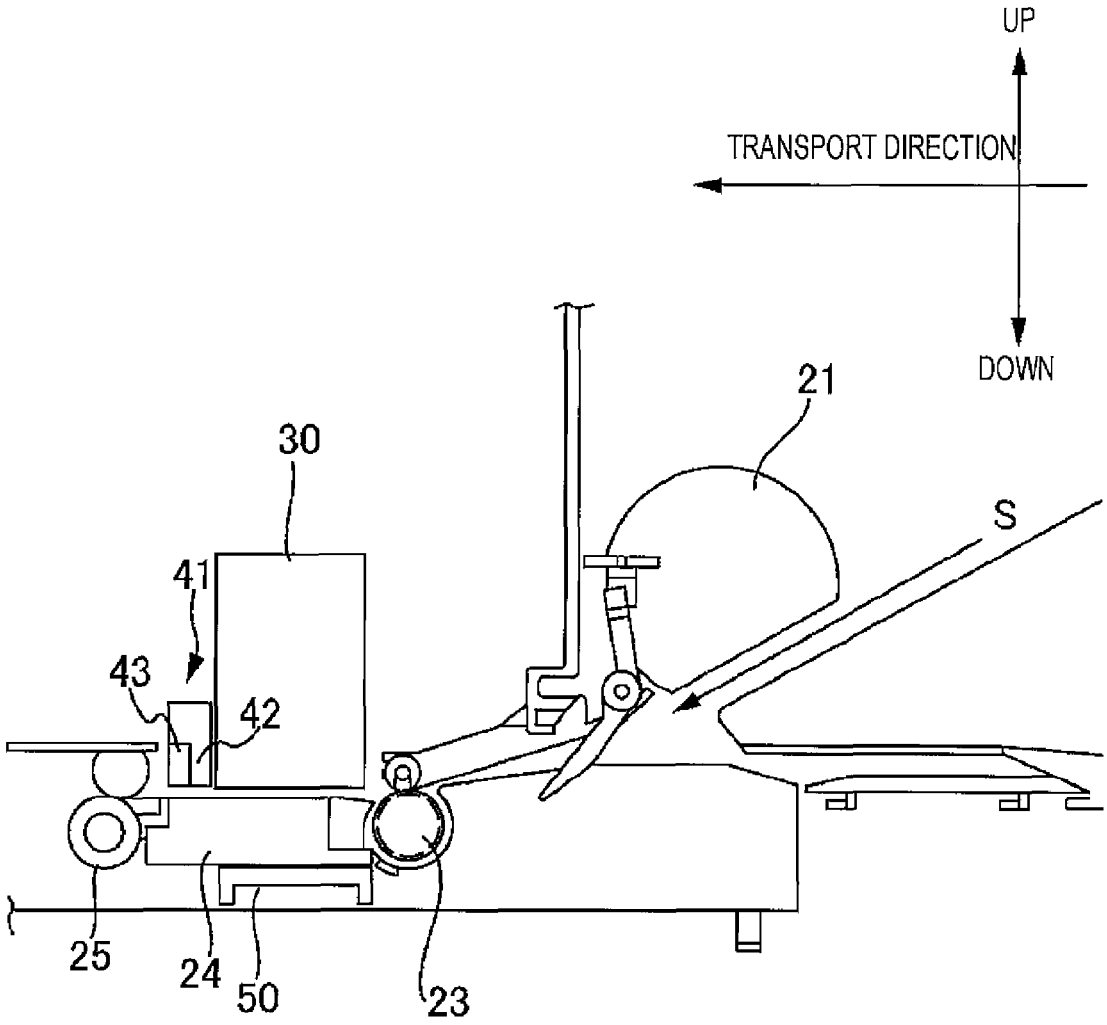
FIG. 2 is a cross-sectional view of the printer.

FIG. 1 is a block diagram illustrating the overall configuration of a printer 1 according to this embodiment. FIG. 2 is a cross-sectional view of the printer 1. The printer 1 that receives print data from a computer 60 serving as an external apparatus controls individual units (transport unit 20 and head unit 30) by means of a controller 10, and forms an image on a paper S. In addition, a detector group 40 monitors the status of the printer 1, and the controller 10 controls the individual units according to the monitoring result.

The controller 10 is a control unit that controls the printer 1. An interface unit 11 performs data transmission and reception between the computer 60 serving as an external apparatus and the printer 1. A CPU (Central Processing Unit) 12 is an arithmetic processing unit that controls the entire printer 1. A memory 13 is used to secure an area for storing the program of the CPU 12 or a work area. The CPU 12 controls the individual units by means of a unit control circuit 14 according to the program stored in the memory 13.

The transport unit 20 feeds the paper S to a printable position and transports the paper S in a transport direction by a predetermined transport amount during printing. The transport unit 20 has a supply roller 21, a transport motor (not shown), a transport roller 23, a platen 24, and a paper discharge roller 25. By rotating the supply roller 21, the paper S to be printed is fed to the transport roller 23.

The head unit 30 is to eject ink onto the paper S. The head unit 30 has four heads 31 (nozzle arrays). At the lower surface of the head 31, a plurality of nozzles serving as ink ejecting portions are provided. Each of the nozzles is provided with an ink chamber (not shown) into which ink is filled. The paper S is transported by the transport unit 20 at a predetermined speed without being stopped. When the paper S passes below the head unit 30, ink is intermittently ejected from the nozzles. As a result, dot rows each having a plurality of dots are formed on the paper S along the transport direction, thereby forming an image.

Regarding Nozzle Surface

Figure 3A:
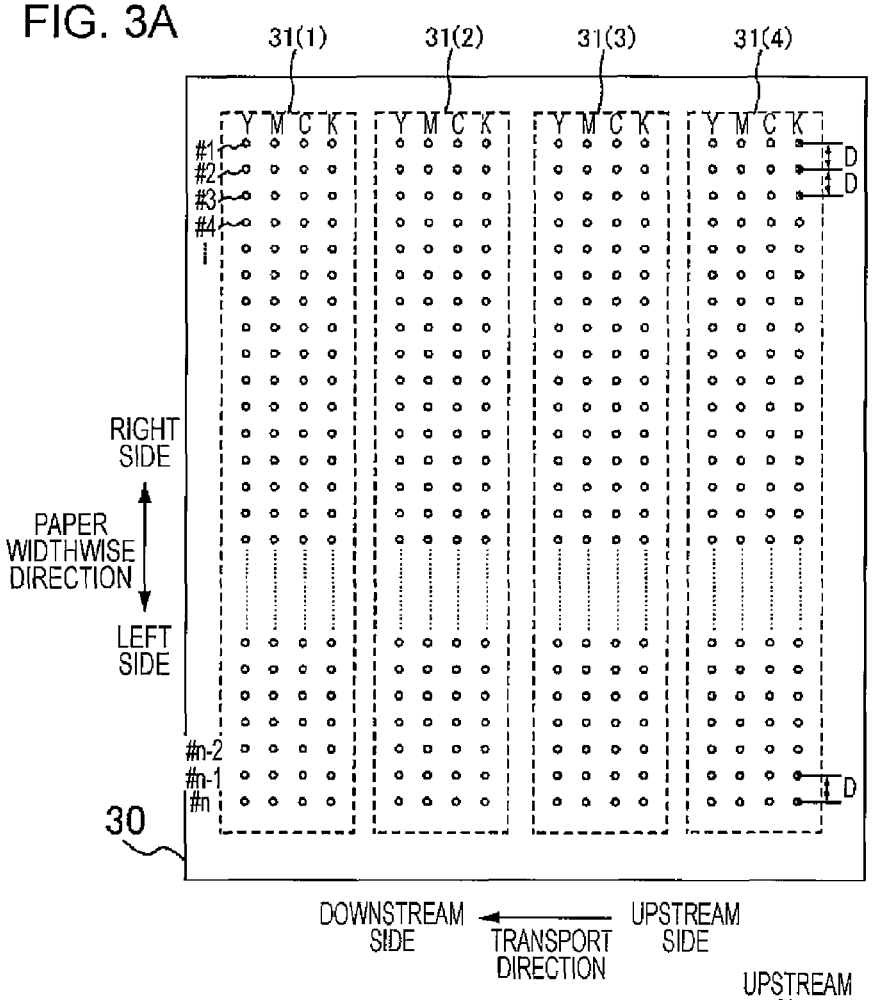
FIG. 3A is a diagram illustrating the nozzle arrangement at a lower surface of a head unit.

FIG. 3A is a diagram illustrating the nozzle arrangement at the lower surface of the head unit 30. The head unit 30 has four heads 31. It is assumed that a first head 31(1), a second head 31(2), a third head 31(3), and a fourth head 31(4) are arranged in this order from a downstream side of the transport direction.

At the lower surface of each head 31, four nozzle arrays are formed along a paper widthwise direction. A yellow ink nozzle array Y, a magenta ink nozzle array M, a cyan ink nozzle array C, and a black ink nozzle array K are arranged in this order from the downstream side.

Each nozzle array has n nozzles, and the n nozzles are arranged at predetermined intervals D in the paper widthwise direction. For example, if it is assumed that the printer 1 can print on the entire surface of an A4 paper (210 mm×297 mm), and the long 297 mm side of the A4 paper follows the paper widthwise direction, the nozzles are arranged over a length more than 297 mm in the paper widthwise direction (more than a width of an object to be printed). In each nozzle array, the nozzles are sequentially numbered from a right side in the paper widthwise direction (a right side when the head unit 30 is viewed from the lower surface) (#i=1 to n).

In this embodiment, the nozzle interval D is set to be 1600 dpi. The nozzle arrays of each head 31 are not staggered in the paper widthwise direction, but for example, the rightmost nozzles #1 of each nozzle array are arranged along the transport direction. For this reason, in this embodiment, the maximum resolution in the paper widthwise direction of the printer 1 becomes 1600 dpi.

Figure 3B:
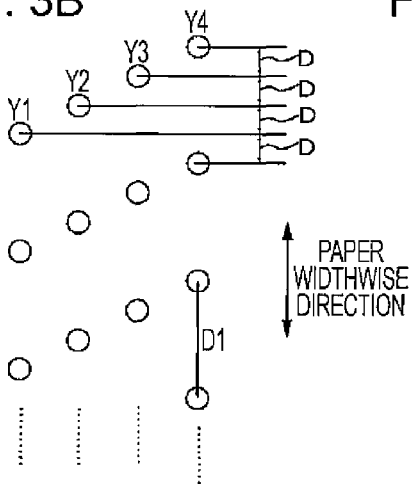
FIGS. 3B and 3C are diagrams illustrating examples of the nozzle arrangement.
Figure 3C:
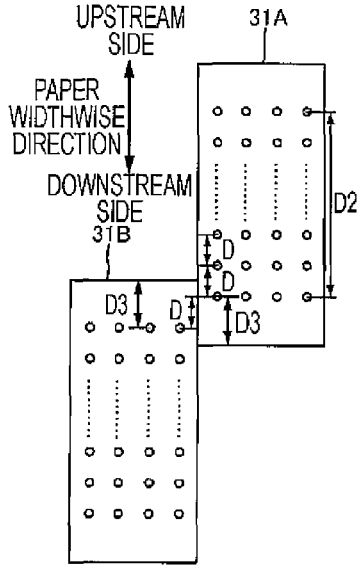

FIGS. 3B and 3C are diagrams illustrating examples of the nozzle arrangement. In the nozzle array of this embodiment, the nozzles are arranged over a long region (approximately the long side of the A4 paper) with a high density (1600 dpi) in the paper widthwise direction. However, the nozzle interval or the length of the nozzle array may be limited due to a manufacturing problem.

For example, as shown in FIG. 3B, when a minimum nozzle interval D1 to be manufactured is 400 dpi, four nozzle arrays Y1 to Y4 may be staggered at regular intervals D (1600 dpi) in the paper widthwise direction. Accordingly, the nozzles can be arranged with a high density in the paper widthwise direction.

As shown in FIG. 3C, when the maximum length of the nozzle array D2 to be manufactured is 1 inch, and an interval D3 between the nozzle array and an upstream end (or a downstream end) of the head 31 is equal to or more than the nozzle interval D, a plurality of heads are arranged in zigzag manner. Then, two heads 31A and 31B are arranged such that an interval between a lowermost nozzle of the upper head 31A and an uppermost nozzle of the head 31B in the paper widthwise direction becomes the nozzle interval D. In this way, the nozzles can be arranged over a long region in the paper widthwise direction.

Ink Ejection Method

Figure 4:
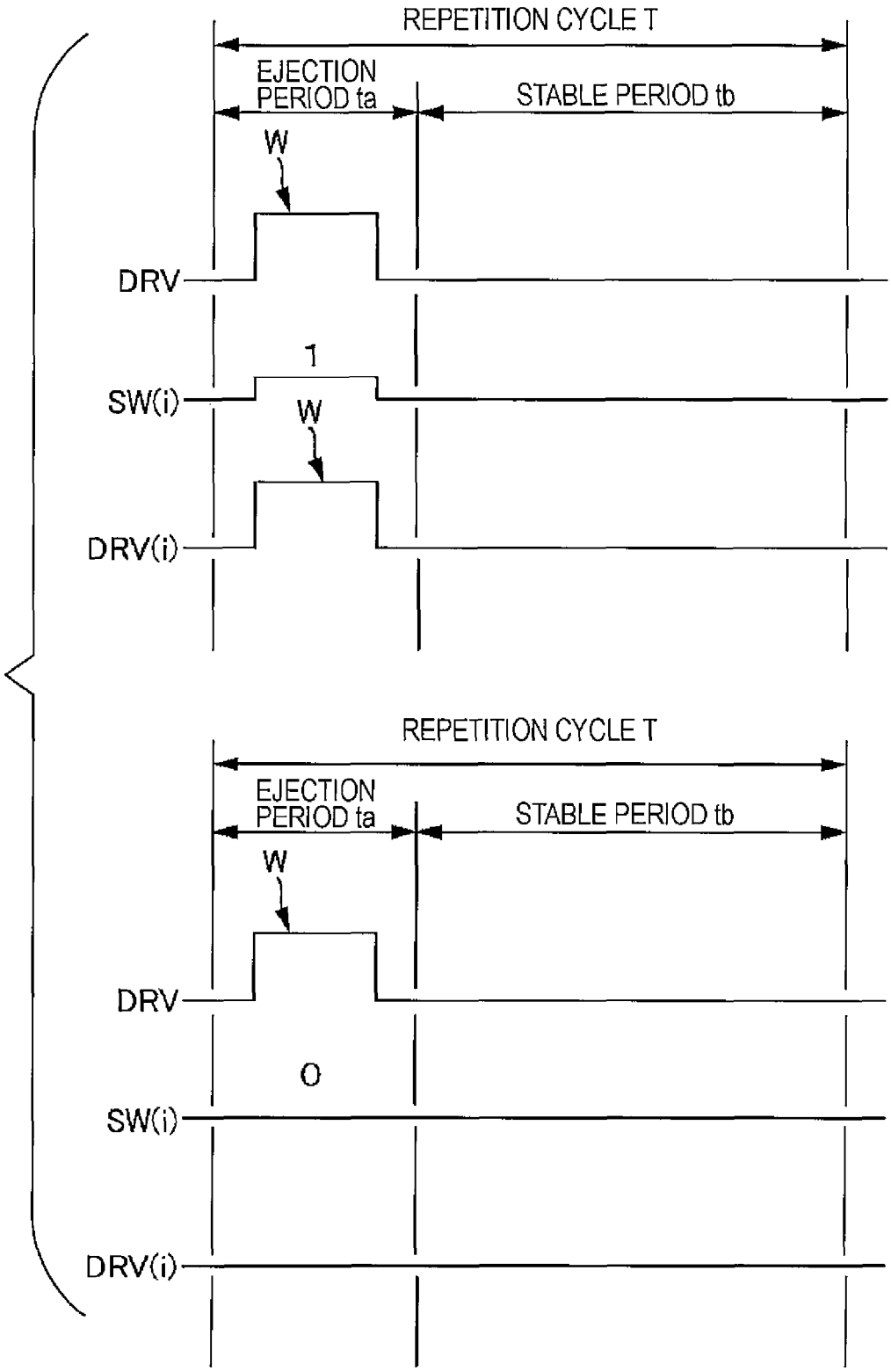
FIG. 4 is a diagram illustrating a driving signal for ejecting ink from nozzles.

FIG. 4 is a diagram illustrating a driving signal DRV for ejecting ink from the nozzles. The driving signal DRV has one driving pulse W within a repetition cycle T. Each nozzle is provided with a switch (not shown) that applies or cuts off the driving signal DRV with respect to a driving element (heat generating element). A switch control signal SW determines whether the driving pulse W is applied to the driving element or cut off. If a switch control signal SW(i) is '1' for a nozzle #i, the driving pulse W is applied to the driving element. Meanwhile, if the switch control signal SW is '0', the driving pulse W is cut off and not applied to the driving element.

For example, when the driving element is a piezoelectric element and ink is ejected by using a piezoelectric method, if the driving pulse W is applied to a piezoelectric element in each nozzle, the volume of the ink chamber into which ink is filled is changed, and then ink is ejected. Meanwhile, when ink is ejected by using a thermal method, if the driving pulse W is applied to a heat generating element (heater) in each nozzle, ink in the ink chamber is vaporized to form air bubbles, and is then ejected by the air bubbles.

In this embodiment, it is assumed that a period in which the driving pulse W is applied or not applied to the driving element (heat generating element) is an ejection period ta within the repetition cycle T. Ink is ejected during the ejection period ta. Accordingly, when a pixel is assigned to the nozzle #i, the nozzle #i needs to at least face the corresponding pixel during the ejection period ta.

The term 'pixel' means a unit area for forming an image. Pixels are arranged two-dimensionally, thereby forming an image. In this embodiment, it is assumed that a 'resolution of transport direction ×paper widthwise direction' is printed with a 'resolution of 1600 dpi×1600 dpi'. In this case, a pixel has a size of '$1/1600$ inch×$1/1600$ inch'.

Within the repetition cycle T, a stable period tb in which no driving pulse W is present is provided after the ejection period ta. If a dot is formed again by using the nozzle #i without the stable period tb immediately after a dot is formed by using the nozzle #i, it is impossible to accurately form a dot. This is because the amount of ink in the ink chamber is decreased immediately after ink is ejected. Immediately after ink is ejected, that is, before ink is supplied from an ink tank into the ink chamber, even if ink is ejected from the nozzle #i again, ink may not be ejected in an accurate amount. In addition, immediately after ink is ejected, the meniscus of the nozzle (the free surface of ink exposed to the outside) may be vibrated. In this case, ink is not ejected in an accurate amount.

That is, during a period until ink is ejected next time after the ink is ejected from the nozzle #i, it is necessary to leave a predetermined time interval (stable period tb). That is, the number of dots which can be formed within a predetermined period by using the same nozzle is limited. In this embodiment, it is assumed that the number of dots which can be formed within the repetition cycle T is one. Moreover, in this embodiment, the stable period tb is set to be longer than the ejection period ta.

Regarding Defective Nozzle Examination Method and Cleaning

Moisture in ink is easily evaporated from the meniscus of the nozzle, and viscosity of ink is increased (ink is thickened) due to the evaporation. If ink is thickened, the nozzle easily becomes clogged. In addition, if air is mixed from the meniscus surface of the nozzle, air bubbles occur in ink. Then, even if ink is ejected from the nozzles on the basis of the print data, ink may not be ejected or an appropriate amount of ink may not be ejected due to nozzle clogging or air bubble mixing. For this reason, an image may be deteriorated, As such, a nozzle from which an appropriate amount of ink is not ejected when ink is to be ejected is called a defective nozzle. The defective nozzle may be recovered to its normal state by a cleaning operation (described below) so as to enable ink to be normally ejected therefrom.

Defective Nozzle Examination Method

In this embodiment, presence/absence of a defective nozzle is examined on the basis of the actual print result. To this end, as shown in FIG. 2, a defective nozzle examination unit 41 is provided on a downstream side from the head unit 30. The defective nozzle examination unit 41 includes a sensor 42 and a light source 43. The sensor 42 and the light source 43 are provided above the paper S to be transported. Moreover, the sensor 42 is constituted from a line sensor (for example, CCD sensor) that extends in the paper widthwise direction, similarly to the nozzle array (FIG. 3A)

In order to examine a defective nozzle, light is irradiated onto a surface to be printed from the light source 43 and reflected light from the surface to be printed is read by the sensor 42. Then, on the basis of the reading result, a dead dot or misalignment of a dot forming position is checked to examine presence/absence of a defective nozzle.

Cleaning

In this embodiment, as a cleaning method that recovers a defective nozzle to its normal state, 'flushing'is performed. Flushing is a cleaning operation that causes ink droplets to be compulsively ejected from the nozzle. To this end, as the preparation of flushing (cleaning), it is necessary to arrange a nozzle surface to face a cap 50 (ink discharge portion). If the nozzle surface and the cap 50 face each other, the cap 50 can receive ink to be discharged by flushing, and thus the platen 24 or the medium can be prevented from being contaminated. Moreover, though not shown, ink received by the cap 50 is discharged to a waste ink tank through a tube, which is connected to the inner bottom of the cap 50.

To arrange the nozzle surface (the lower surface of the head unit 30) to face the cap 50, as shown in FIG. 2, the cap 50 is provided below the platen 24, and the platen 24 and the cap 50 are arranged to rotate toward the head unit 30. That is, during printing, the platen 24 and the nozzle surface face each other, and the platen 24 supports the paper S. During cleaning, the platen 24 and the cap 50 rotate, and then the cap 50 and the nozzle surface face each other, such that waste ink by flushing is received by the cap 50.

Alternatively, a cap may be provided in an area (non-printing area) other than an area where the paper S is printed, and the head unit 30 may be moved to the non-printing area to arrange the nozzle surface and the cap to face each other. In addition, a cap may be provided above the head unit 30, and the head unit 30 may be rotated to arrange the nozzle surface and the cap to face each other.

As a cleaning operation other than flushing, a pump may be provided in the tube, which is connected to the bottom of the cap, to compulsively suck ink in the ink chamber through the nozzle surface (pump suction), or a rubber wiper may be provided to remove foreign substances over the nozzle surface.

With such a cleaning operation, ink is normally ejected from a nozzle, which was a defective nozzle. Moreover, since printing is suspended during cleaning, a print time becomes longer by the time required for cleaning. In addition, since flushing or pump suction is performed, ink is consumed for other purposes than printing.

Regarding Print Method

Print Method When No Defective Nozzle is Detected

Figure 5:
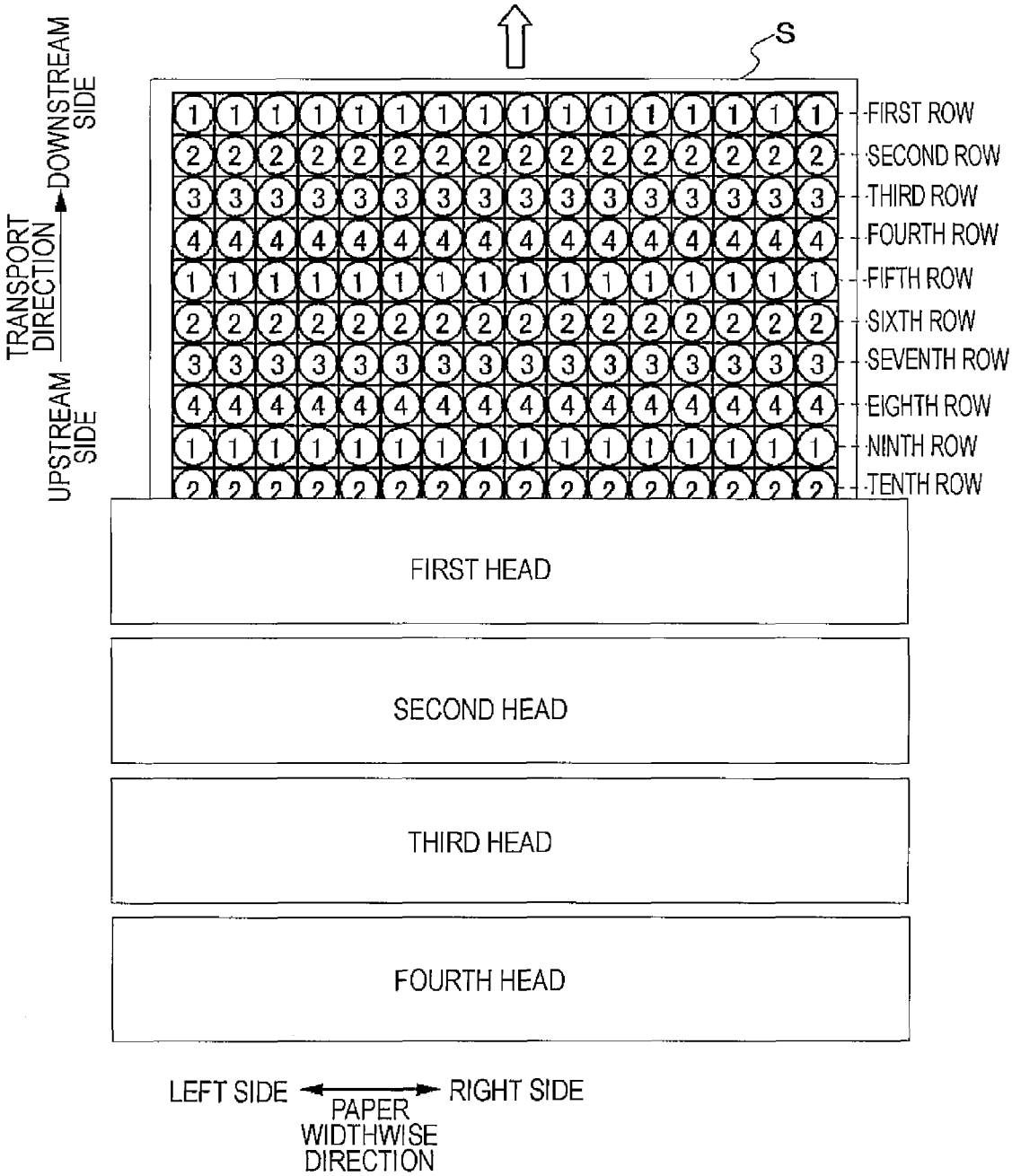
FIG. 5 is a diagram illustrating a print method when no defective nozzle is detected.

FIG. 5 is a diagram illustrating a print method when no defective nozzle is detected. Each of grids on the paper S corresponds to a pixel, and pixels arranged in the paper widthwise direction are represented by 'row'. In FIG. 5, the numeral '1' is written in the dots (O) of the first row to indicate that the dots are formed by the nozzles in the first head 31(1). The numeral '2' is written in the dots of the second row. It can be seen that the dots of the second row are formed by the nozzles in the second head 31(2). Similarly, the dots of the third row are formed by the third head 31(3), and the dots of the fourth row are formed by the fourth head 31(4). The numeral '1' is written in the dots of the fifth row. It can be seen that the dots formed in the pixels of the fifth row are formed by the nozzles in the first head 31(1) again.

That is, the head 31 is changed to form the dots for the pixels of a row in the paper widthwise direction. The heads 31 are allocated from the pixels on the downstream side in the transport direction in an order of the first head 31(1), the second head 31(2), the third head 31(3), and the fourth head 31(4).

Specifically, the nozzles in the first head 31(1) are allocated to the pixels of the first row, the fifth row, the ninth row, . . . , and the nozzles in the second head 31(2) are allocated to the pixels of the second row, the sixth row, the tenth row, . . . . In addition, the nozzles in the third head 31(3) are allocated to the pixels of the third row, the seventh row, the eleventh row, . . . , and the nozzles in the fourth head 31(4) are allocated to the pixels of the fourth row, the eighth row, the twelfth row, . . . .

That is, in a print method when no defective nozzle is detected, the four heads 31 are sequentially used, and the dots to be formed in the pixels lying next to each other in the transport direction are formed by the nozzles of different heads 31.

Figure 6:
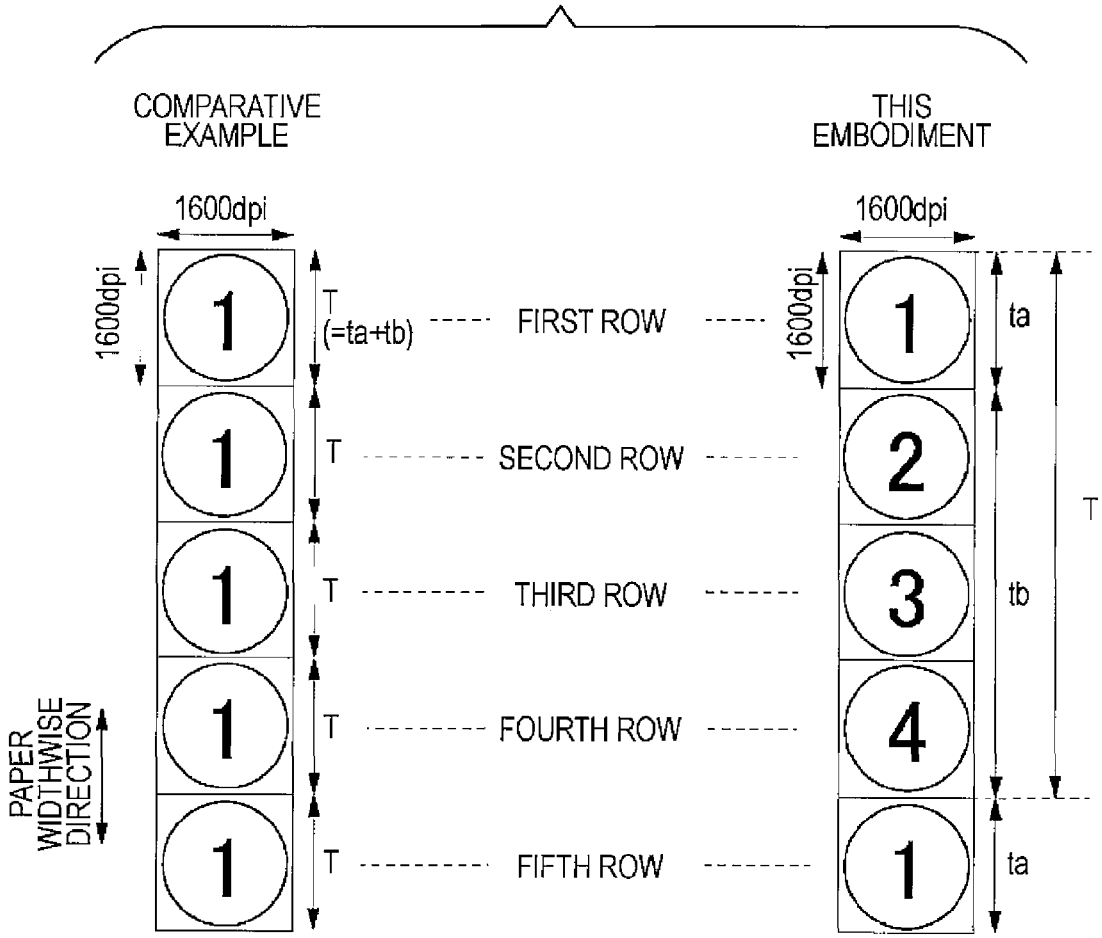
FIG. 6 is a diagram illustrating a print method in a printer according to a comparative example and a print method in a printer according to an embodiment of the invention.

FIG. 6 is a diagram illustrating a print method in a printer according to a comparative example and a print method in the printer 1 of this embodiment. Here, as the printer of the comparative example, a printer that only includes the first head 31(1) shown in FIG. 3A is used. In the printer of the comparative example, all the pixels to be printed are allocated to the first head 31(1). In contrast, in the printer of this embodiment, the pixels to be printed are sequentially allocated to the four heads 31. That is, the number of pixels to be allocated to a single head is quarter of the total number of pixels to be printed. For this reason, in this embodiment, the head 31 is less frequently used, compared with the comparative example and thus lifespan of the head 31 can be extended.

In this embodiment, the dots that are formed in the four pixels arranged in the transport direction are formed by different heads 31 (FIG. 6). In contrast, in the comparative example, the dots that are formed in the pixels arranged in the transport direction are all formed by the same head (FIG. 6). In particular, in case of a line head printer, since printing is performed while the paper S is transported below the head, without moving the head. Accordingly, like the comparative example, in a printer that only includes a single head, the dots of the same color, which are formed in the pixels arranged in the transport direction are all formed by the same nozzle. For this reason, in the printer of the comparative example, a tendency unique to a nozzle due to a manufacturing error easily appears in the image. For example, a nozzle that tends to eject ink with an insufficient amount is allocated to the pixels arranged in the transport direction. If so, a stripe may occur in the printed image along the transport direction.

That is, like the printer of the comparative example, if the same nozzle is allocated to all of the pixels arranged in the transport direction, the pixels are largely affected by the allocated nozzle, which results in image deterioration. In contrast, in the printer of this embodiment, the pixels arranged in the transport direction are formed by four nozzles (per color), and thus the tendency unique to the nozzle can be reduced, and thus high-quality image can be obtained.

In the printer of the comparative example (FIG. 6), since the same nozzle #i is allocated to the pixels arranged in the transport direction, during a period from when a dot is formed in the pixel of the first row by the nozzle #i until a dot is formed in the pixel of the second row, the stable period tb shown in FIG. 4 needs to be provided. For this reason, a time in which a pixel and a nozzle #i face each other becomes a time (period) corresponding to the repetition cycle T. which is the sum of the ejection period ta and the stable period tb. That is, in the comparative example, a time in which the paper S is transported over a length of 1/1600 inch (the length of a pixel in the transport direction) becomes the time corresponding to the repetition cycle T.

Meanwhile, in the printer of this embodiment (FIG. 6), different nozzles are allocated to the four pixels arranged in the transport direction. A nozzle in the first head 31(1) is allocated to the pixel of the first row, and a nozzle in the second head 31(2) is allocated to the pixel of the second row. Accordingly, the nozzle #i allocated to the pixel of the first row can be ready to eject ink next time with a period, in which it faces the pixels of the second to fourth rows after ejecting ink onto the pixel of the first row, as the stable period tb. That is, in this embodiment, the time in which the paper S is transported over the length of 1/1600 inch (the length of a pixel in the transport direction) can be set to be shorter than the time corresponding to the repetition cycle T (ta+tb). Therefore, a print time can be reduced, compared with the comparative example.

That is, in this embodiment, what is necessary is that the paper S is transported such that the period in which a nozzle #i and a pixel (first row) face each other is equal to or more than the ejection period ta, and a period in which a single nozzle #i faces three pixels (the second to fourth rows) is equal to or more than the stable period tb. If so, the nozzle #i allocated to the pixel of the first row forms a dot while facing the pixel of the first row, and a time corresponding to the stable period tb lapses during the nozzle #i faces the pixels of the second to fourth rows Accordingly, the nozzle #i can form a next dot in the pixel of the fifth row.

For example, it is assumed that the stable period tb is three times longer than the ejection period ta (tb=3 ta), and the paper S is transported over the length of 1/1600 inch during the ejection period ta. If so, the paper S is transported over a length of 3/1600 inch during the stable period tb (=3 ta), such that the paper S is transported over a length corresponding to four pixels during the period corresponding to the repetition cycle T. In this case, the printer of this embodiment can perform printing at speed four times faster than the printer of the comparative example, in which the paper S is transported over a length corresponding to a pixel during the repetition cycle T.

In summary, when no defective nozzle is detected, for the pixels (row) arranged in the paper widthwise direction, printing is performed by sequentially using all the heads 31 in the printer 1. According to this print method, lifespan of the head can be extended, and the tendency unique to the nozzle can be suppressed. As a result, a high-quality image can be obtained, and the print time can be reduced.

First Print Method When Defective Nozzle is Detected

In the first print method, when a defective nozzle is detected by the above-described defective nozzle examination method, printing is performed without using a head 31 in which the defective nozzle is detected.

Figure 7A:
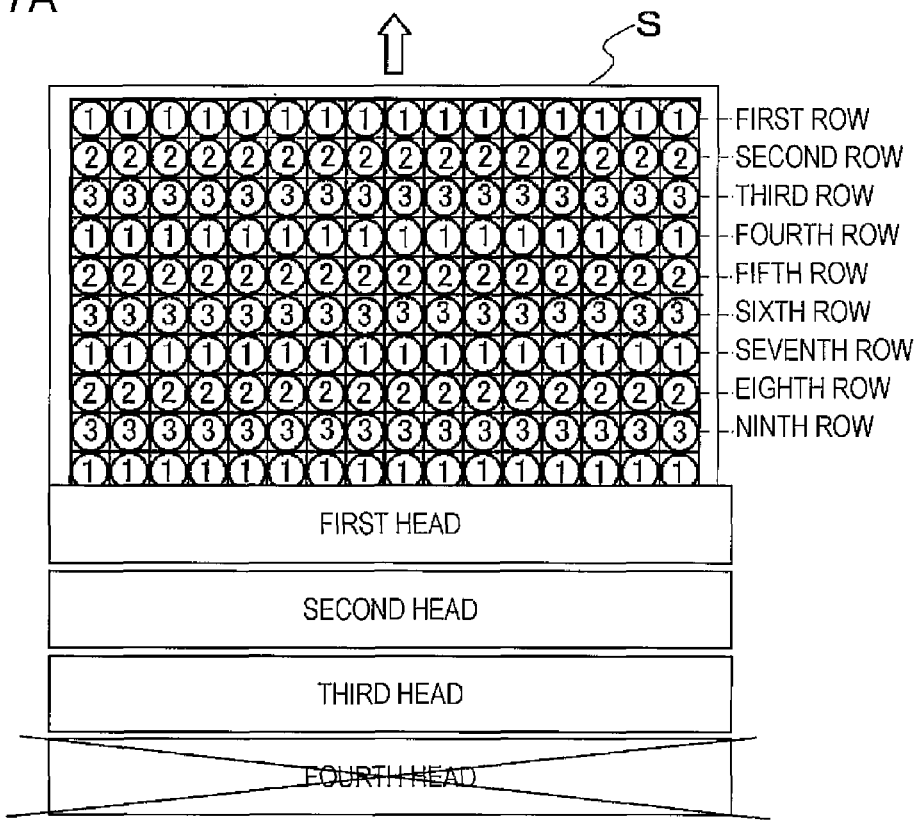
FIG. 7A is a diagram illustrating a print method when a defective nozzle is detected in a fourth head.

FIG. 7A is a diagram illustrating a print method when a defective nozzle is detected in the fourth head 31(4). For example, when a nozzle in the fourth head 31(4) is detected as a defective nozzle, printing is performed by using the remaining three heads 31(1) to 31(3), excluding the fourth head 31(4). In this case, as shown in FIG. 7A, for the pixels (row) arranged in the paper widthwise direction, the first head 31(1), the second head 31(2), and the third head 31(3) are allocated in this order from the downstream side, and then printing is performed. That is, the first head 31(1) is allocated to the pixels of the first row, the fourth row, the seventh row, . . . , the second head 31(2) is allocated to the pixels of the second row, the fifth row, the eighth row, . . . , and the third head 31(3) is allocated to the pixels of the third row, the sixth row, the ninth row, . . . .

Figure 7B:
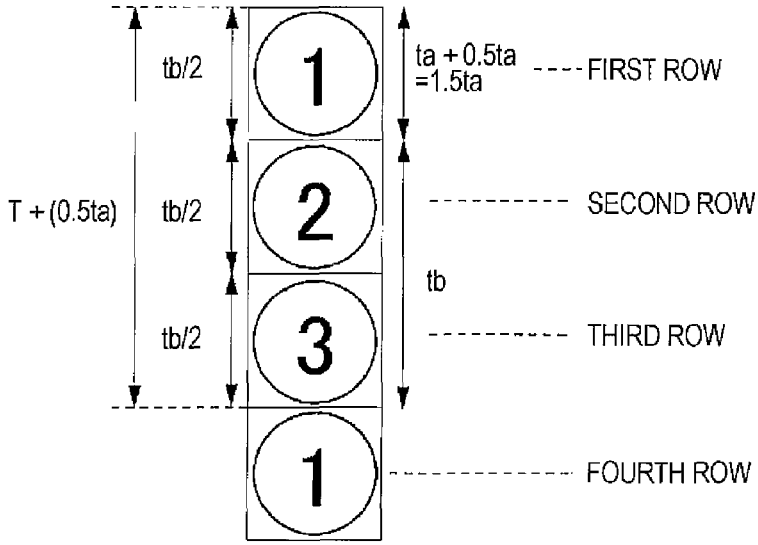
FIG. 7B is a diagram illustrating a transport time when printing is performed without using a fourth head.

FIG. 7B is a diagram illustrating a transport time when printing is performed without using the fourth head 31(4). As shown in FIG. 6, when printing is performed by using the four heads 31, the stable period tb is preferably provided while the nozzle #i faces the three pixels (the pixels of the second row to the fourth row) after forming a dot in the pixel of the first row. Meanwhile, when printing is performed by using three heads 31, the stable period tb needs to be provided while the nozzle #i faces two pixels (the pixels of the second row and the third row) after forming a dot in the pixel of the first row. For this reason, in the first print method that performs printing without using a head 31 in which a defective nozzle is detected, the transport speed is decreased and the print time is increased, compared with a case in which printing is performed by using all the four heads 31.

For example, if a period in which the nozzle #i faces the pixels of the second row and the third row after forming a dot in the pixel of the first row is set as the stable period tb of the nozzle #i, the paper S is transported over a length corresponding to a single pixel (1/1600 inch) during a period (tb/2 ), which is half of the stable period tb. Moreover, since the transport speed is constant, a period in which the nozzle #i faces the pixel of the first row also becomes tb/2. Accordingly, if the stable period tb is three times longer than the ejection period ta (tb=3 ta), the condition tb/2=1.5 ta is satisfied, and a period in which the nozzle #i faces the pixel of the first row becomes longer than the ejection period ta. For this reason, it is necessary to add a delay period (0.5 ta) to the ejection period ta shown in FIG. 4. As a result, when printing is performed by using the three heads 31, the paper S is only transported over a length corresponding to the three pixels arranged in the transport direction during a period, which is the sum of the repetition cycle T and the delay period (0.5 ta). Accordingly, according to the first print method, the print time is increased, compared with a case in which printing is performed by using the four heads (FIG. 6).

Figure 8:
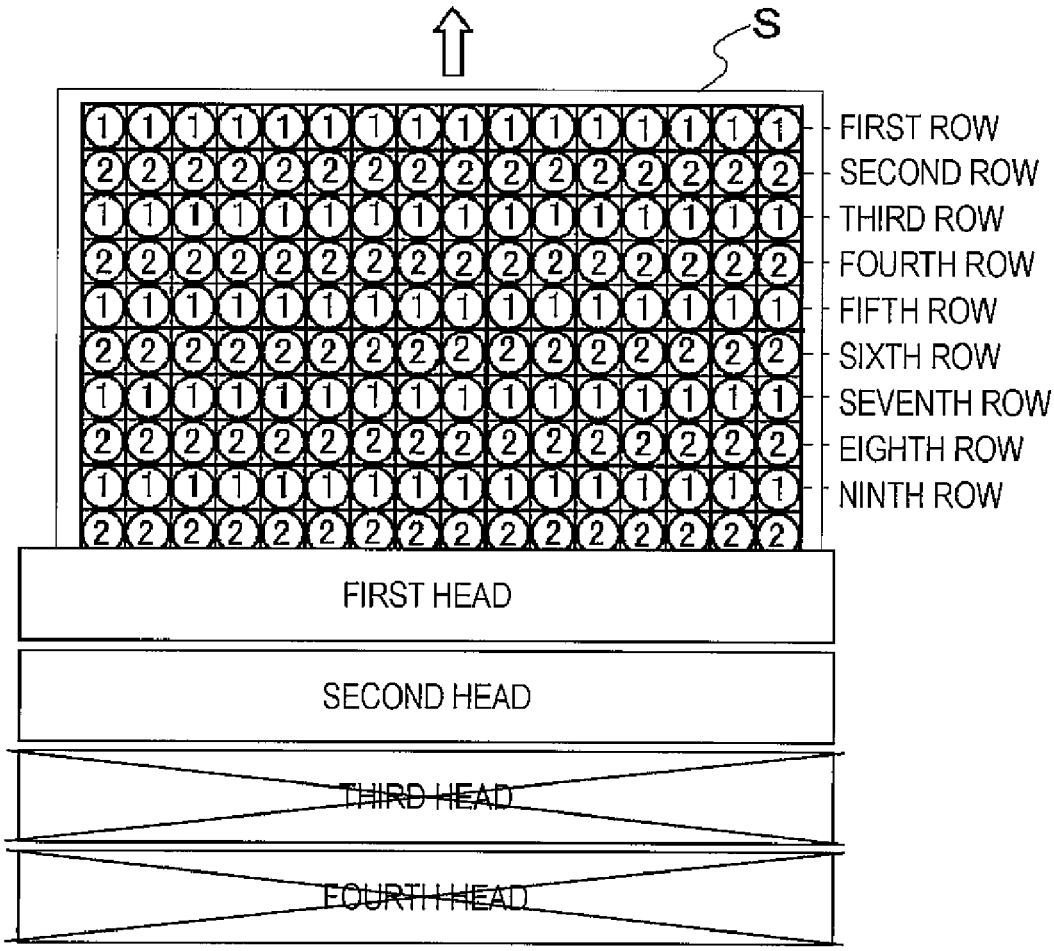
FIG. 8 is a diagram illustrating a print method when defective nozzles are detected in a third head and a fourth head.

FIG. 8 is a diagram illustrating a print method when defective nozzles are detected in the third head 31(3) and the fourth head 31(4). When defective nozzles are detected in the two heads 31, printing is performed by using the remaining two heads 31. In this case, since ink is alternately ejected from the first head 31(1) and the second head 31(2), while the nozzle #i faces the pixel of the third row after forming a dot in the pixel of the first row, the nozzle #i needs to be ready to form a next dot. For this reason, when printing is performed by using the two heads, the print time is further increased, compared with a case in which printing is performed by using the three heads 31 (FIG. 7B).

That is, in the first print method, even if a defective nozzle is detected, printing is performed by using the remaining heads 31, in which no defective nozzle is detected, without performing cleaning. For this reason, an additional cleaning time is not required, but the number of usable heads is decreased. Accordingly, an image forming time is increased (the transport speed is decreased), compared with a case in which printing is performed by using all the heads 31 (four).

Second Print Method When Defective Nozzle is Detected

In a second print method, when a defective nozzle is detected by the above-described defective nozzle examination method, cleaning is performed so as to enable ink to be normally ejected from the defective nozzle, and then printing is performed by using all the heads 31 (four).

That is, in the second print method, an additional cleaning time is required, compared with the first print method, but printing can be performed by using all the heads 31 (four). Accordingly, the image forming time is reduced, compared with the first print method (the transport speed is increased, compared with the first print method).

In any of the first print method and the second print method, printing is performed without using a defective nozzle (or after a defective nozzle is recovered to its normal state), and thus image deterioration, such as dead dot, can be suppressed.

Overall Flow of Printing

Figure 9:
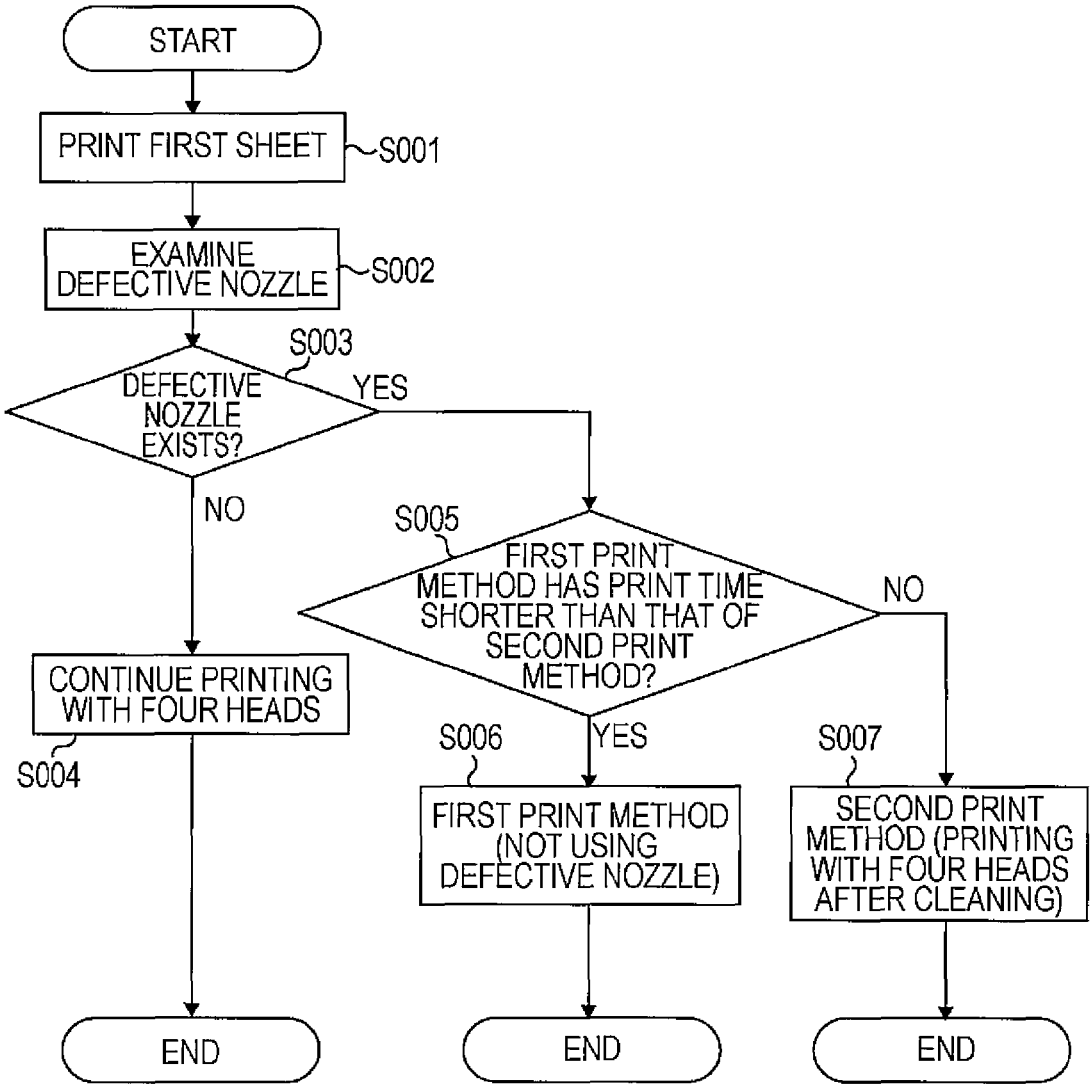
FIG. 9 is a printing flowchart of a printer according to an embodiment of the invention.

FIG. 9 is a printing flowchart of the printer 1 according to this embodiment. If the printer 1 receives a print command and print data (for a print job of multiple sheets, for example), the printer 1 prints a first sheet (Step S001). Moreover, first sheet printing is performed by using the four heads 31, regardless of presence/absence of a defective nozzle that is, printing is performed by the above-described print method when no defective nozzle is detected (FIG. 5). The defective nozzle examination unit 41 examines a defective nozzle on the basis of an image formed on a first sheet of paper S (Step S002).

When no defective nozzle is detected (Step S003: NO), printing is performed by the print method when no defective nozzle is detected (FIG. 5), that is, a second sheet and later are printed by using the four heads 31 (Step S004), and then the print job ends.

Meanwhile, in the defective nozzle examination, when a defective nozzle is detected (Step S003: YES), the controller 10 of the printer 1 determines which of the first print method and the second print method prints the second sheet and later and ends the print job faster (has a shorter print time) (Step S005). Moreover, when defective nozzles are detected from all the heads 31, printing cannot be performed, and thus the second print method is inevitably selected.

In the defective nozzle examination, when a defective nozzle is detected, since first sheet printing is performed by using the defective nozzle, in case of an image of the first sheet, image quality may be deteriorated due to a dead dot. Accordingly, a user may be informed that, in case of first sheet printing, image quality may be deteriorated. In this case, the user may confirm whether or not, in a state where no defective nozzle is present, to re-print a sheet (first sheet), which was printed by using a defective nozzle.

When the first print method has a shorter print time than that of the second print method (YES), printing is performed by the first print method (Step S006). That is, as shown in FIG. 7A or 8, the second sheet and later are printed without using a head 31, in which a defective nozzle is detected.

Moreover, even if defective nozzles are detected from three heads 31 and printing is inevitably performed by a remaining head 31, when the first print method has a shorter print time than that of the second print method, printing is performed by using the single head 31, without performing cleaning.

At Step S005, the following calculation is performed. For example, it is assumed that a cleaning time is S, an image forming time per sheet when printing is performed without using a head 31, in which a defective nozzle is detected, is T1 (first print method), an image forming time per sheet when printing is performed by using all the four heads 31 is T2, and the number of remaining sheets to be printed is N. Here, when the condition 'Print Time of First Print Method (T1×N)<Print Time of Second Print Method (S+T2×N)' is satisfied, printing is performed by the first print method.

To the contrary, when the first print method has a longer print time than that of the second print method (NO), printing is performed by the second print method (Step S007). That is, when the condition 'Print Time of First Print Method (T1×N) >Print Time of Second Print Method (S+T2×N)' is satisfied, cleaning is performed to recover the defective nozzle to its normal state, and then printing is performed by using the four heads 31.

That is, in the printer 1 of this embodiment, when a defective nozzle is detected, a method, in which printing is performed after cleaning is performed to recover the defective nozzle to its normal state, and a method, in which printing is performed without performing cleaning and without using the defective nozzle, are compared with each other, and printing is performed by a print method having a shorter print time. With this configuration, the print time (corresponding to a processing time) can be reduced. Moreover, when the first print method has the same print time as that of the second print method, the first print method, in which cleaning is not performed, may be selected so as to reduce ink consumption by cleaning. If the controller 10 of the printer 1 is adapted to perform the print method selection, the controller 10 corresponds to a control unit. In addition, the computer 60, which is connected to the printer 1, may perform the print method selection. In this case, the computer 60 corresponds to the control unit, and a print system in which the printer 1 and the computer 60 are connected corresponds to a liquid ejecting apparatus.

In a line head printer, such as the printer 1 of this embodiment, high-speed printing can be performed. Accordingly, a difference between the image forming time T1 per sheet when printing is performed without using a head 31, in which a defective nozzle is detected, and the image forming time T2 per sheet by the four heads becomes shorter than the cleaning time S. However, since the line head printer can perform high-speed printing, it is effective to perform a large amount of printing (several hundred sheets to several thousand sheets). When a large amount of printing is performed, even if cleaning is performed, a method having a shorter image forming time per sheet (second print method) can complete printing faster.

Meanwhile, when the number of sheets to be printed is small, a method (first print method) in which printing is performed without using a head 31 having a defective nozzle completes printing faster than a method (second print method) in which cleaning is performed and printing is performed by using the four heads 31. In addition, in case of the line head printer, the number of nozzles is large, and thus if cleaning is performed, a large amount of ink is consumed. Accordingly, if cleaning is performed in spite of a small amount of printing, ink may be uselessly consumed. That is, according to this embodiment, the print time can be reduced, and also ink consumption by cleaning can be reduced as small as possible.

In the foregoing description, a case in which the defective nozzle examination is performed after the first sheet printing is completed, and then the second sheet and later are printed has been described, but it is intended to limit the invention. For example, during the defective nozzle examination, the second sheet may start to be printed. With this configuration, when no defective nozzle is detected from the image result of the first sheet, the print time can be reduced. However, when a defective nozzle is detected from the image result of the first sheet, a dead dot may occur in the image of the second sheet, as well as the first sheet, and as a result, printing is uselessly performed in a state where a defective nozzle is present.

Figure 10:
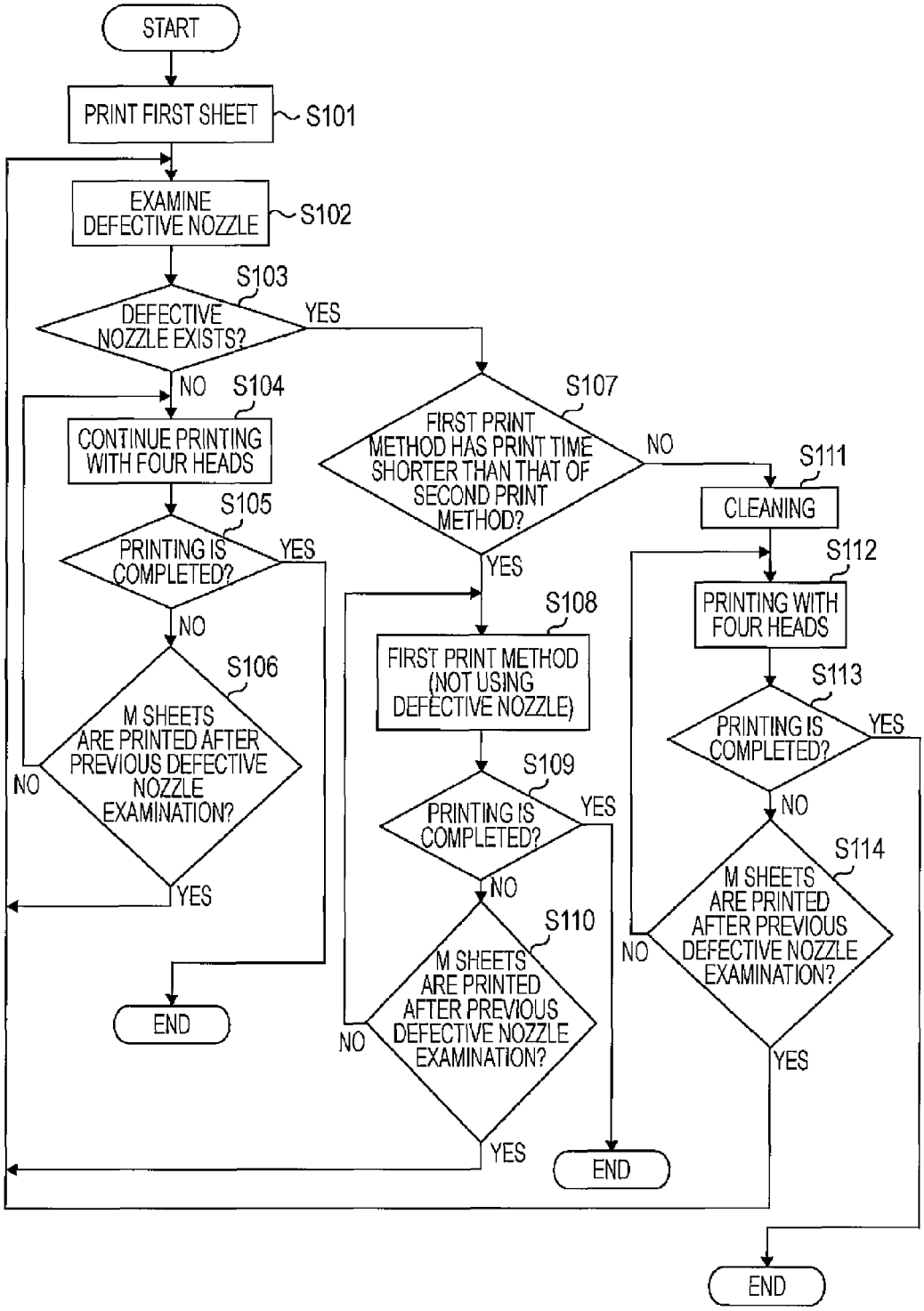
FIG. 10 is a diagram illustrating a modification of a print method according to an embodiment of the invention.

FIG. 10 is a diagram illustrating a modification of the print method according to this embodiment. In the flowchart of FIG. 9, a defective nozzle is detected from the print result of the first sheet, but it is not intended to limit the invention. Since a defective nozzle newly occurs during printing, the defective nozzle examination may be performed for every predetermined number of sheets (M).

Similarly to the foregoing printing flow, first, presence/absence of a defective nozzle is examined on the basis of the print result of the first sheet, a method that has a shorter print time without causing image deterioration is selected from among three kinds of print methods (the print method when no defective nozzle is detected, the first print method, and the second print method). After a predetermined number of sheets (M) are printed, when more sheets are printed (Steps S106, S110, and S114: NO), the defective nozzle examination (Step S102) is performed again. For this reason, for every predetermined number of sheets (M), a print method that has a shorter print time without causing image deterioration is selected.

Although no defective nozzle is detected from the print results of the first sheet and the (M+1)th sheet, when a defective nozzle is detected from the print result of the (2M+1)th sheet, from the (M+2)th to (2M+1)th sheets, a dead dot by the defective nozzle may be observed, and image deterioration may be caused. Accordingly, the purport is preferably informed to the user.

When a defective nozzle is examined for every predetermined number of sheets (M), when M sheets or more remain, the print time calculation at Step S107 may be omitted. For example, when printing is performed by the first print method before the defective nozzle examination, and no defective nozzle is newly detected, the first print method has a shorter print time than a case in which cleaning is performed. Accordingly, while the print time calculation may not be performed at Step S107, the first print method may be selected. In addition, even if a defective nozzle is newly detected, the defective nozzle belongs to a head 31 (an unused head 31) in which another defective nozzle has already been detected, the print time calculation may be omitted, and the first print method may be selected.

Other Embodiments

In the foregoing embodiment, a print system that includes an ink jet type printer has been primarily described, but the disclosure on a method of selecting a print method is also included. In addition, the foregoing embodiment is set forth for the sake of ease of understanding of the invention, but it is not to be interpreted as limiting the invention. The invention can of course be modified and improved without departing from the scope of the invention, and includes the equivalents. In particular, the following embodiments are also included in the invention.

Regarding Print Method When Defective Nozzle is Detected

Figure 11A:
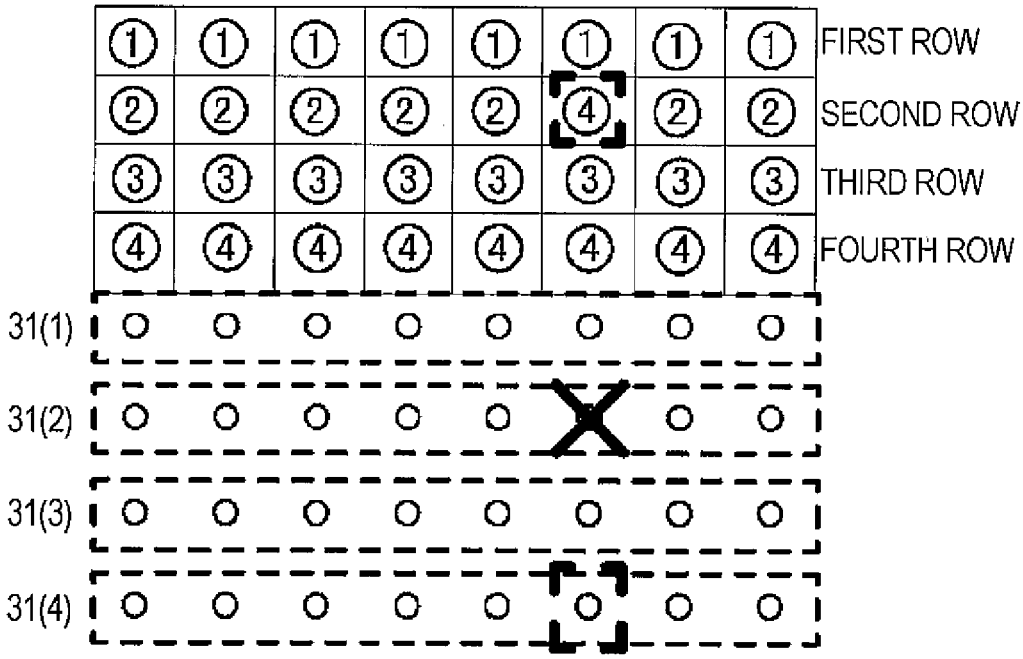
FIGS. 11A and 11B are diagrams illustrating an example of a print method when a defective nozzle is detected.

In the foregoing embodiment, in the first print method when a defective nozzle is detected, a head 31 in which the defective nozzle is detected is not used. That is, other nozzles in the head 31 in which the defective nozzle is detected are not used even if they are normal, but the invention is not limited thereto. For example, as shown in FIG. 11A, printing may be performed without using only the defective nozzle, not the head 31 in which a defective nozzle is detected. FIG. 11A shows a case in which a nozzle (x) among the nozzles in the second head 31(2) is detected as a defective nozzle. A nozzle in the fourth head 31(4) is substitutively allocated to the pixel of the second row, to which the defective nozzle in the second head 31(2) is allocated. Normal nozzles in the second head 31(2) are used in printing to form dots in the pixels of the second row.

In view of reduction in the print time, preferably, the defective nozzle and the substitute nozzle are not nozzles that are allocated to adjacent pixels in the transport direction. For example, if a nozzle in the second head 31(2) is a defective nozzle, a nozzle in the fourth head 31(4) is selected as a substitute nozzle. In addition, if a nozzle in the first head 31(1) is a defective nozzle, a nozzle in the third head 31(3) is selected as a substitute nozzle.

According to a print method in which only a defective nozzle is not used, similarly to the above-described second print method, the nozzles can be evenly used, compared with a print method in which a head having a defective nozzle is not used. However, while a nozzle #i in the fourth head 31(4) faces the pixel of the third row after forming a dot in the pixel of the second row, the nozzle #i needs to be ready to form a next dot. Accordingly, the above-described second print method (FIG. 7B) has a shorter print time than that of the print method shown in FIG. 11A.

Figure 11B:
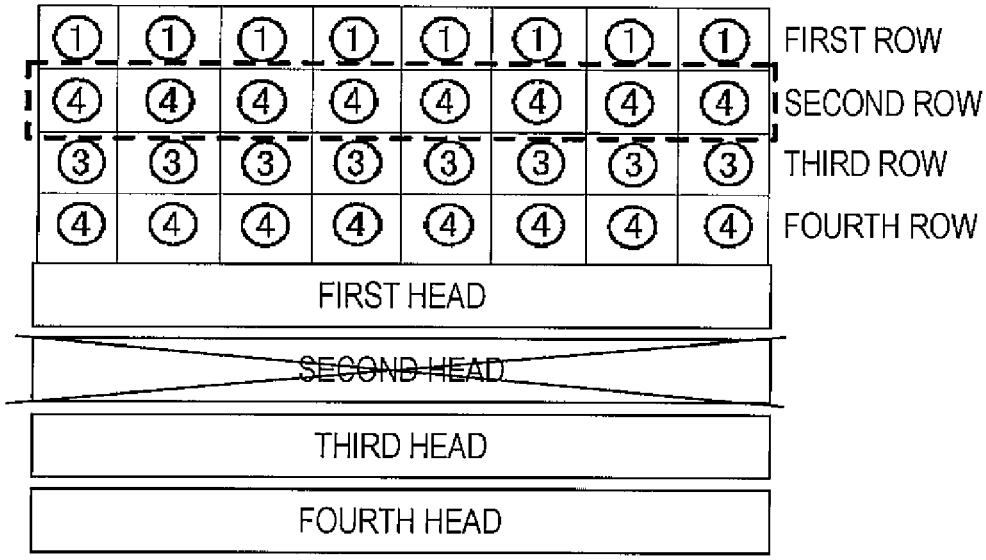

In the foregoing embodiment, as shown in FIG. 7A, when a defective nozzle is detected in the fourth head 31(4), printing is performed by sequentially using the remaining three heads 31(1) to 31(3), but the invention is not limited thereto. For example, as shown in FIG. 11B, when a defective nozzle is detected in the second head 31(2), all the pixels that were allocated to the second head 31(2) may be allocated to the fourth head 31(4). However, in the print method of FIG. 11B, while the fourth head 31(4) faces a pixel of the third row, it needs to be ready to eject ink next time. In contrast, in the second print method of FIG. 7A when a defective nozzle is detected in a single head, each head may be ready to eject ink next time while facing the two pixels. Therefore, the print time can be reduced. In addition, the nozzles can be evenly used.

Alternatively, the pixels that were allocated to the second head 31(2) may be allocated to one of the first head 31(1), the third head 31(3), and the fourth head 31(4). However, if the pixels that were allocated to the second head 31(2) are allocated to the first and third heads 31(1) and 31(3), the first and third heads 31(1) and 31(3) need to successively eject ink onto adjacent pixels in the transport direction. Accordingly, in order to secure the stable period of the nozzle after ink is ejected, the transport speed needs to be decreased. For this reason, the above-described second print method can reduce the print time.

Regarding Defective Nozzle Examination Method

In the foregoing embodiment, a printed image is read in order to detect a defective nozzle, but the invention is not limited thereto. For example, a defective nozzle may be detected by laser. In the defective nozzle detection by laser, a defective nozzle is detected according to whether or not laser emitted from a laser light source is blocked by ink.

With this defective nozzle examination method, multiple nozzles may be selectively examined. Accordingly, similarly to the print method of FIG. 10, when detective nozzle examination is performed for every predetermined number of sheets, and before nozzle examination, printing is performed without using a head having a defective nozzle (first print method), since the head in which the defective nozzle has already been detected is unusable, defective nozzle examination may be performed for nozzles of the heads in which no defective nozzle was detected.

Regarding Transport Mechanism and Recovery Mechanism (Cleaning)

In the foregoing embodiment, the paper S is transported by the transport roller, but the invention is not limited thereto. For example, the paper S may be transported by a transport belt that is rotated according to the rotation of the transport roller. In a line head printer in which multiple heads are arranged in the transport direction, an interval between an upstream side transport roller and a downstream side transport roller is increased. Accordingly, by using the transport belt, the paper S can be prevented from being flexed downward. Moreover, when the paper S is transported by the transport belt, preferably, the paper S is absorbed onto the transport belt by electrostatic absorption or vacuum absorption. In addition, during cleaning, an aperture may be provided in the transport belt so as to arrange the nozzle surface and the cap to face each other.

Regarding Liquid Ejecting Apparatus

In the foregoing embodiment, an ink jet printer is described as a liquid ejecting apparatus (part) that executes a liquid ejecting method, but the invention is not limited thereto. The invention can also be applied to various industrial apparatuses insofar as they are liquid ejecting apparatuses, in addition to the printer (printing apparatus). For example, the invention can be applied to a textile printing apparatus which attaches film patterns to cloth, a color filter manufacturing apparatus, an organic EL display manufacturing apparatus, a DNA chip manufacturing apparatus which manufactures a DNA chip by coating a DNA-dissolved solution on a chip, and a circuit board manufacturing apparatus.

The liquid ejecting method may be a piezoelectric method which ejects a liquid by applying a voltage to a driving element (piezoelectric element) to expand and contract an ink chamber, or may be a thermal method which generates air bubbles in a nozzle by using a heat generating element and ejects a liquid by the air bubbles.

Serial-Type Printer

In the foregoing embodiment, the description has been made by way of an ink jet printer, particularly, a line head printer, but it is not intended to limit the invention. For example, a serial-type printer in which a head moves in a movement direction intersecting the transport direction may be used. In this case, the serial-type printer includes a plurality of heads (a plurality of nozzle arrays) in the movement direction, and performs printing by sequentially using the plurality of heads for the pixels arranged in the movement direction.

What is claimed is:

1. A liquid ejecting apparatus, comprising:

a plurality of nozzles that eject a liquid;

a sensor that detects a defective nozzle in which defective ejection occurs when the liquid is to be ejected;

a recovery mechanism that recovers the defective nozzle to its normal state so as to enable the liquid to be normally ejected from the defective nozzle;

a control unit that, when a defective nozzle is detected, compares a first method, in which the liquid is ejected after the defective nozzle is recovered to its normal state by the recovery mechanism, with a second method, in which the liquid is ejected without using the defective nozzle, while the defective nozzle is not recovered to its normal state, and controls the liquid to be ejected by using one of the first or the second method having a shorter processing time.

2. The liquid ejecting apparatus according to claim 1, wherein, when the liquid is ejected without using the defective nozzle, for a pixel assigned with the defective nozzle, the liquid is ejected from another nozzle that can eject the liquid normally.

3. The liquid ejecting apparatus according to claim 1, wherein a plurality of nozzle arrays each having a plurality of nozzles are provided, and when a defective nozzle is detected, the control unit compares a method, in which the liquid is ejected after the defective nozzle is recovered to its normal state by the recovery mechanism, with a method, in which the liquid is ejected without using a nozzle array in which the defective nozzle is detected, while the defective nozzle is not recovered to its normal state.

4. The liquid ejecting apparatus according to claim 3, further comprising:

a transport mechanism that transports a medium in a transport direction, wherein the plurality of nozzle arrays are arranged in line along the transport direction, and when the liquid is ejected without using the nozzle array in which the defective nozzle is detected, for pixels arranged in a line along the transport direction, nozzle arrays in which no defective nozzle is detected are sequentially allocated.

5. The liquid ejecting apparatus according to claim 1, wherein the control unit compares a time, which is the sum of a time required to recover the defective nozzle to its normal state by using the recovery mechanism and a time required to eject the liquid by using all of the plurality of nozzles, with a time required to eject the liquid without using the defective nozzle.

6. The liquid ejecting apparatus according to claim 1, wherein the first method of ejecting the liquid after the recovery and the second method of ejecting the liquid without using the defective nozzle are compared with each other, and when the processing times of both methods are the same, the liquid is ejected without using the defective nozzle.

7. A liquid ejecting method, comprising:

in a liquid ejecting apparatus including a plurality of nozzles that eject a liquid, a sensor that detects a defective nozzle in which defective ejection occurs when the liquid is to be ejected, and a recovery mechanism that recovers the defective nozzle to its normal state so as to enable the liquid to be normally ejected from the defective nozzle, examining presence/absence of a defective nozzle by means of the sensor;

when a defective nozzle is detected, comparing a first method, in which the liquid is ejected after the defective nozzle is recovered to its normal state by the recovery mechanism, with a second method, in which the liquid is ejected without using the defective nozzle, while the defective nozzle is not recovered to its normal state, and determining one of the first and the second method as having a shorter processing time; and ejecting the liquid by using the determined method.

* * * * *